US006796318B2

(12) United States Patent
Cohen et al.

(10) Patent No.: US 6,796,318 B2
(45) **Date of Patent: *Sep. 28, 2004**

(54) FAN ASSEMBLY FOR AN UMBRELLA

(75) Inventors: Ronald B. Cohen, Hopkinton, MA (US); Wayne Wallen, Amston, CT (US)

(73) Assignee: New Products Too, LLC, Westborough, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/335,745

(22) Filed: Jan. 2, 2003

(65) Prior Publication Data

US 2003/0168091 A1 Sep. 11, 2003

Related U.S. Application Data

(63) Continuation-in-part of application No. 10/193,879, filed on Jul. 12, 2002, which is a continuation-in-part of application No. 10/006,097, filed on Dec. 4, 2001, now Pat. No. 6,732,752.

(51) Int. Cl.[7] ..... A45B 23/00; F16M 13/00

(52) U.S. Cl. ..... 135/16; 416/224 R

(58) Field of Search ..... 416/244 R, 146 R, 416/204 R; 135/16; 417/313

(56) References Cited

U.S. PATENT DOCUMENTS

| | | | | |
|---|---|---|---|---|
| 1,148,332 | A | | 7/1915 | Onyskow |
| 3,177,881 | A | | 4/1965 | Covington |
| 5,007,811 | A | * | 4/1991 | Hopkins |
| 5,172,711 | A | * | 12/1992 | Mueller et al. |
| 5,273,062 | A | * | 12/1993 | Mozdzanowski |
| 5,349,975 | A | | 9/1994 | Valdner |
| 5,765,582 | A | | 6/1998 | Molnar, IV |
| 5,887,771 | A | | 3/1999 | Perry |
| D409,369 | S | | 5/1999 | Vega |
| 5,967,161 | A | | 10/1999 | Neal |
| RE36,514 | E | * | 1/2000 | Clark |
| 6,017,188 | A | * | 1/2000 | Benton |
| 6,027,309 | A | | 2/2000 | Rawls et al. |
| 6,230,723 | B1 | | 5/2001 | Hixson |
| 6,325,084 | B1 | * | 12/2001 | Cohen |
| 2002/0096203 | A1 | | 7/2002 | Cohen et al. |
| 2003/0102021 | A1 | | 6/2003 | Cohen et al. |

FOREIGN PATENT DOCUMENTS

| | | | | |
|---|---|---|---|---|
| RO | 108408 | * | 5/1994 | ..... A45B/11/04 |

* cited by examiner

*Primary Examiner*—Robert Canfield
(74) *Attorney, Agent, or Firm*—Iandiorio & Teska

(57) ABSTRACT

A fan assembly with a split collar clampable about a pole, the split collar including a drive ring support. A split motor housing is clampable about the split collar and the split motor housing includes a drive mechanism. A split drive ring is rotatably clampable about the split collar and supported by the drive ring support. The split drive ring includes a driven mechanism driven by the drive mechanism. A plurality of fan blades are coupled to the split drive ring. The fan assembly can be easily raised up or lowered down an umbrella pole. When the fan assembly is in the lowered position and the fan blades are removed, the umbrella can be easily stored away with the fan assembly still assembled about the umbrella pole.

19 Claims, 25 Drawing Sheets

FAN ASSEMBLY FOR AN UMBRELLA

RELATED APPLICATIONS

This Application is a Continuation-in-Part of application Ser. No. 10/193,879, filed Jul. 12, 2002 also entitled "Fan Assembly for an Umbrella", which is a Continuation-in-Part of application Ser. No. 10/006,097, filed Dec. 4, 2001 now U.S. Pat. No. 6,732,752 also entitled "Fan Assembly for an Umbrella", which are both herein incorporated by reference.

FIELD OF THE INVENTION

This invention relates to a fan assembly for an umbrella and also to a fan assembly which can be coupled to a pole even without an umbrella.

BACKGROUND OF THE INVENTION

There has long been a need for a self-contained, easy to assemble, low cost, universal, and safe umbrella fan. The design constraints associated with such an umbrella fan include the fact that the umbrella canopy is often lowered when not in use by the action of a slide which surrounds the umbrella pole operated by a crank mechanism which also surround the umbrella pole. Thus, any useful after-market umbrella fan assembly must be able to be easily coupled by the consumer to the umbrella pole between the crank mechanism and the umbrella canopy slide.

U.S. Pat. No. 6,017,188 discloses a fan assembly permanently disposed on the umbrella pole above the slide. Accordingly, this assembly is not designed as an after-market fan which can be used in conjunction with a wide variety of umbrellas previously purchased by consumers.

U.S. Pat. No. 5,007,811 discloses a fan assembly supported on an umbrella pole below the umbrella slide but requires, in each embodiment, bearings supporting the integral rotatable drive ring to which the fan blades are attached. In one embodiment, the large drive gear of the rotatable drive ring and the drive ring itself have a slot therethrough for receiving the umbrella shaft. To compensate for this slot, either two opposing drive pinions are required (one on either side of the slot) or, instead, a special gear key is required to fill the gap in the drive gear, and, in that embodiment, only one drive pinion is required.

The '811 patent also purports to show an embodiment where the drive gear and the drive ring are split and pivot about a hinge. Still, even in this embodiment, the bearings supporting the rotatable drive ring are still required as part of the fan assembly housing. Since, in the design of the '811 patent, the drive ring is an integral part of the fan motor housing, the resulting structure is necessarily complex and difficult to manufacture at a low cost. Finally, the '188 patent notes that the fan assembly of the '811 patent is unstable. To our knowledge, no after-market umbrella fan assembly has ever gained market acceptance.

SUMMARY OF THE INVENTION

It is therefore an object of this invention to provide a self-contained after-market fan assembly for umbrellas.

It is a further object of this invention to provide such a fan assembly which is easy to assemble.

It is a further object of this invention to provide such a fan assembly which can be manufactured and sold at a low cost.

It is a further object of this invention to provide such a fan assembly which is universal in design and which can accommodate different umbrella pole diameters and a variety of umbrella configurations.

It is a further object of this invention to provide such a fan assembly which can be easily slid down or decoupled from the umbrella pole when the umbrella canopy is folded down and not in use and then slid back up the umbrella pole and into position or coupled to the pole when the umbrella canopy is deployed.

It is a further object of this invention to provide such a fan assembly which has easily removable contoured fan blades.

It is a further object of this invention to provide such a fan assembly which is battery operated.

It is a further object of this invention to provide such a fan assembly which does not require multiple drive pinions.

It is a further object of this invention to provide such a fan assembly in which the drive ring is not an integral part of the fan motor housing and thus requires no rotatable bearings.

The invention results from the realization that a self contained, universal, and low cost, umbrella fan assembly which is easy to assemble and disassemble is preferably effected by three primary separate assemblies: a split collar clampable around the umbrella pole, a motor housing supported by the split collar, and a separate fan blade drive ring with an integral gear also supported by the split collar. This preferred design is in sharp contrast with the assembly of U.S. Pat. No. 5,007,811 in which the drive ring is an integral part of the motor housing and thus requires expensive bearings and a complex drive train to accommodate the slot in the motor housing.

The invention features a fan assembly fastenable about a pole and includes a collar clampable about the pole and including a drive ring support disposed above a motor housing support; a motor housing clampable about the collar to rest on the motor housing support, the motor housing including a drive mechanism; a drive ring in two sections disposed about the collar to rotatably rest on the drive ring support of the collar, the drive ring including a driven mechanism driven by the drive mechanism of the motor housing; and a plurality of fan blades coupled to the drive ring.

In the preferred embodiment, the fan assembly may further include a coupling clampable about the pole beneath the collar to support the collar on the pole. The drive ring may include a plate extending outward from the collar and the drive mechanism may be a lower gear closely spaced to the collar and driven by the drive mechanism of the motor housing. A first section of the drive ring may circumferentially surround the majority of the collar and a second section of the drive ring may be a key which completes the drive ring. The coupling may include a nut for securing the coupling to the pole. The motor housing may be hinged. The motor housing may include one locking mechanism to clamp the hinged motor housing together about the pole. The locking mechanism may include a sliding clasp for securing two sections of the hinged motor housing together. The locking mechanism may additionally or alternatively include a screw that engages two sections of the hinged motor housing.

The invention also features a fan assembly including a collar in two halves clampable about a pole and including a drive ring support; a motor housing support disposed below the drive ring support; and a clamp for slidably securing the two halves of the collar about the pole, a coupling in two halves clampable about the pole below the collar for supporting the collar on the pole, the coupling including a clamp for securing the two halves about the pole, threaded fingers, and a hinged nut threadable onto the fingers to releasably secure the coupling with respect to the pole; a motor housing in two halves hinged together and supported on the motor housing support of the collar, the motor housing including a battery compartment, a drive gear driven by a motor, and at least one mechanism for securing the two halves together about the collar; a drive ring in two sections disposed about the collar and including a plate portion, a driven gear portion extending downward from the plate portion rotatably supported on the drive ring support of the collar and driven by the drive gear of the motor housing, a first section of the drive ring circumferentially surrounding a majority of the collar, a second section of the drive ring formed as a key which completes the drive ring, and at least one mechanism for securing the key to the first section of the drive ring; and fan blade retaining mechanisms on the plate portion of the drive ring, and a plurality of fan blades releasably coupled to the retaining mechanisms.

BRIEF DESCRIPTION OF THE DRAWINGS

Other objects, features and advantages will occur to those skilled in the art from the following description of a preferred embodiment and the accompanying drawings, in which.

DISCLOSURE OF THE PREFERRED EMBODIMENT

Figure 1:
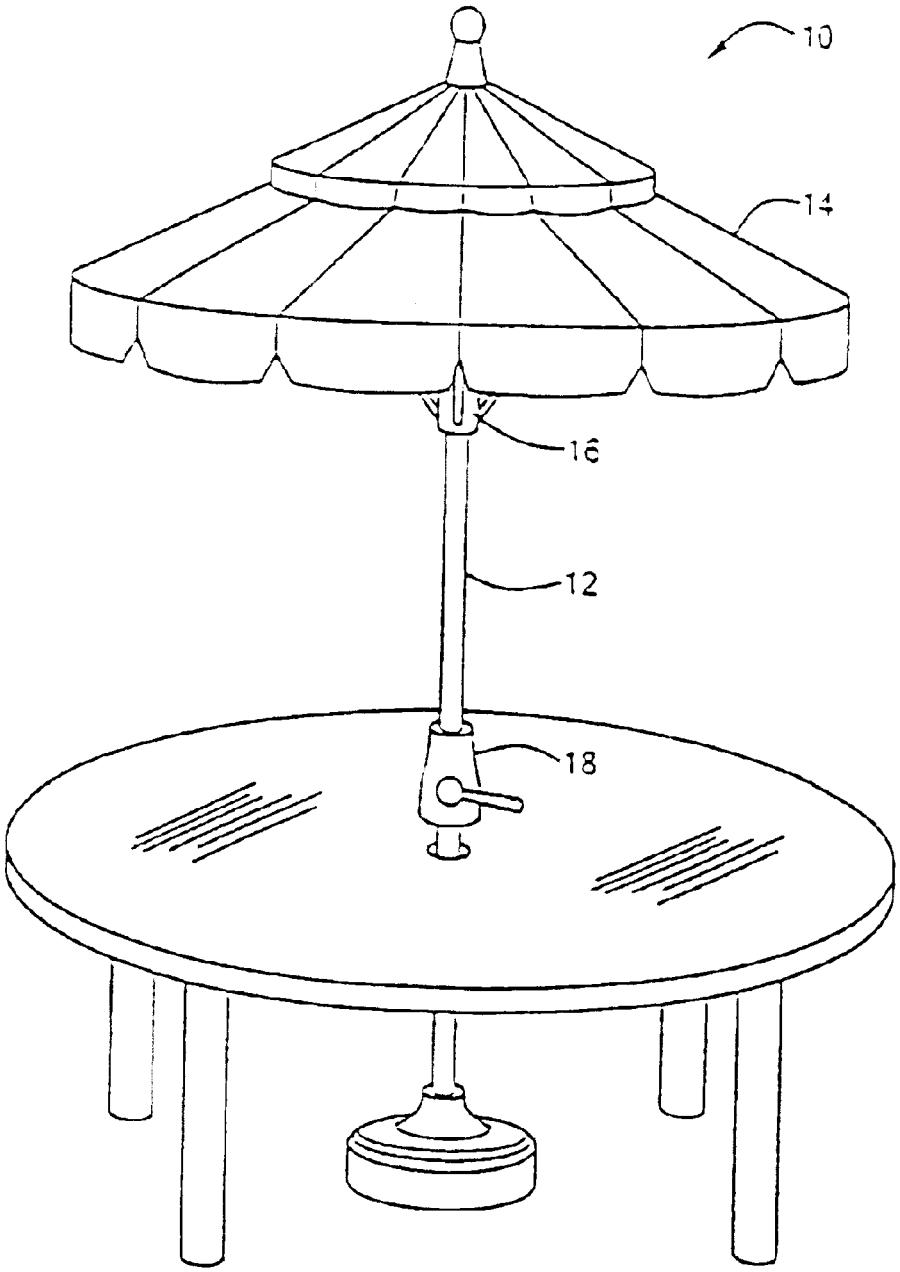
FIG. 1 (PRIOR ART)
FIG. 1 is a schematic view of a typical umbrella assembly.

Conventional umbrella 10, FIG. 1 includes pole 12 and canopy 14 which is lowered and raised as slide 16 moves up and down on pole 12 by the operation of crank mechanism 18.

Thus, many consumers have existing umbrellas which cannot accommodate a fan assembly unless it can be easily coupled about pole 12 between clamp mechanism 18 and slide 16. In addition, when umbrella 10 is not in use and canopy 14 is folded downward, the fan assembly must be moveable down the pole or easily decoupled from the pole so it does not interfere with the operation of slide 16. In addition, any after-market fan assembly design must take into account the fact that the umbrella is often lowered when not in use. Thus, the fan assembly must be easily coupled by the consumer to the pole between the crank mechanism and the slide but also quickly movable down or decoupled from the pole. In addition, any marketable fan assembly must be self-contained, low cost, universal in design, safe, and preferably battery operated to avoid the need for extension cords and the like. Any fan assembly which does not meet these design constraints will not be accepted by consumers.

Figure 2:
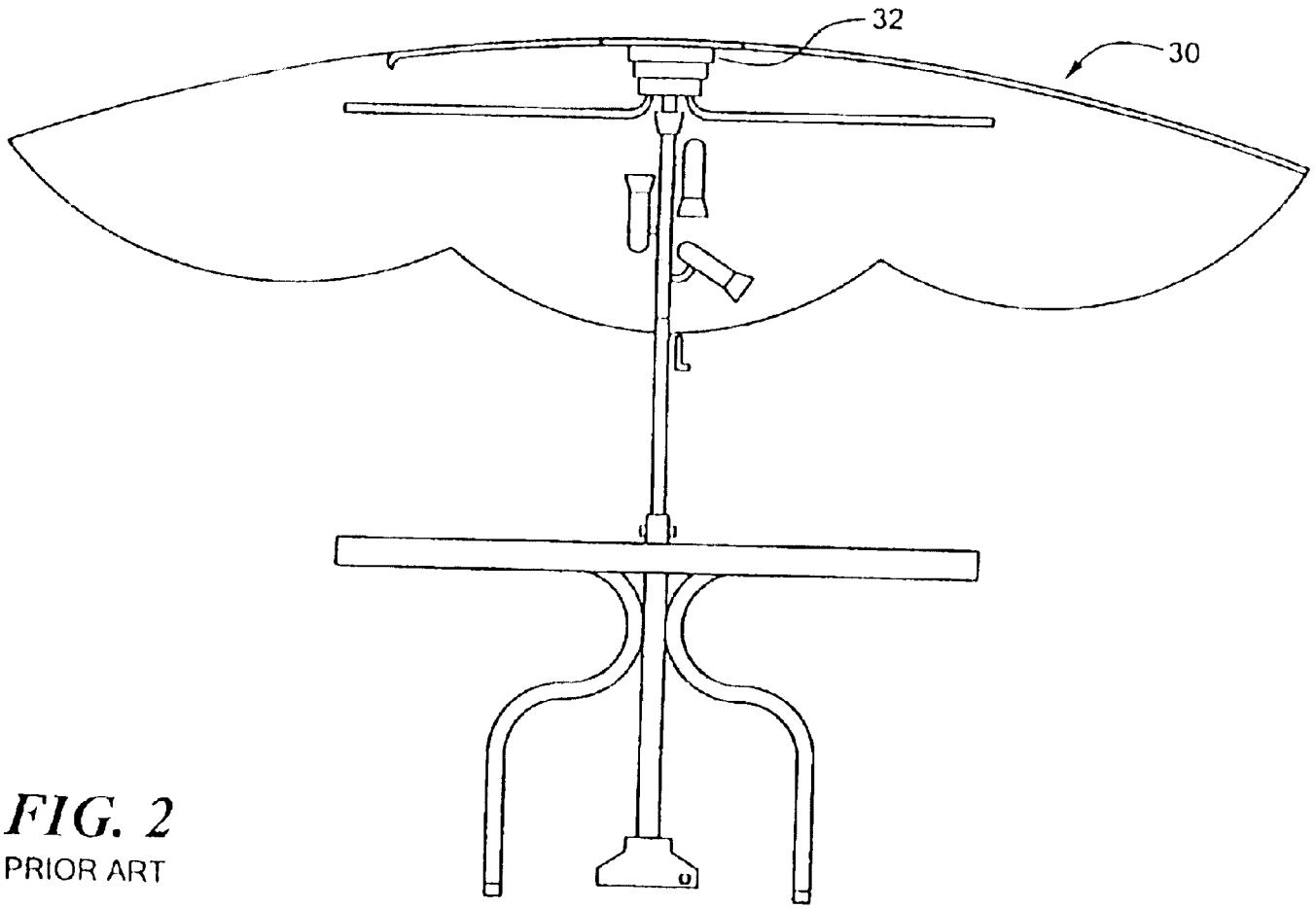
FIG. 2 PRIOR ART
FIG. 2 is a schematic view of a prior art patio table and pole fan combination in accordance with the prior art.

Umbrella 30, FIG. 2 with integral fan assembly 32 is disclosed in U.S. Pat. No. 6,017,188 incorporated herein by this reference. Unfortunately, fan assembly 32 must be incorporated as a component of umbrella 30 and thus, a consumer with umbrella 10, FIG. 1 cannot incorporate fan assembly 32, FIG. 2 therewith.

U.S. Pat. No. 5,007,811, also incorporated herein by this reference, discloses after-market fan assembly 40, FIG. 3. Unfortunately, assembly 40 is complex in design, expensive to manufacture, and unstable. Support 42 supports motor housing 44 thereon. Motor housing 44 then requires bearings 46 which, in turn, support integral fan blade drive ring 48 thereon. Drive gear 50 of drive ring 48 is driven by gear 52 which is coupled to motor M via gear train 54. The large drive gear of the rotatable drive ring (and the drive ring itself) have, in all the preferred embodiments, a slot therethough for receiving the umbrella shaft. To compensate for this slot, either two opposing drive pinions are required (one on either side of the slot) or, instead, a special gear key is required to fill the gap in the drive gear. As delineated in the Background section above, the '811 patent also purports to show an embodiment where the drive gear and the drive ring are split and pivot about a hinge. Still, even in this embodiment, bearings are required to support the rotatable drive ring and the drive ring itself forms an integral part of the fan assembly housing. Since, in the design of the '811 patent, the drive ring is an integral part of the fan motor housing, the resulting structure is necessarily complex, difficult to manufacture, and results in a costly fan assembly.

Figure 4:
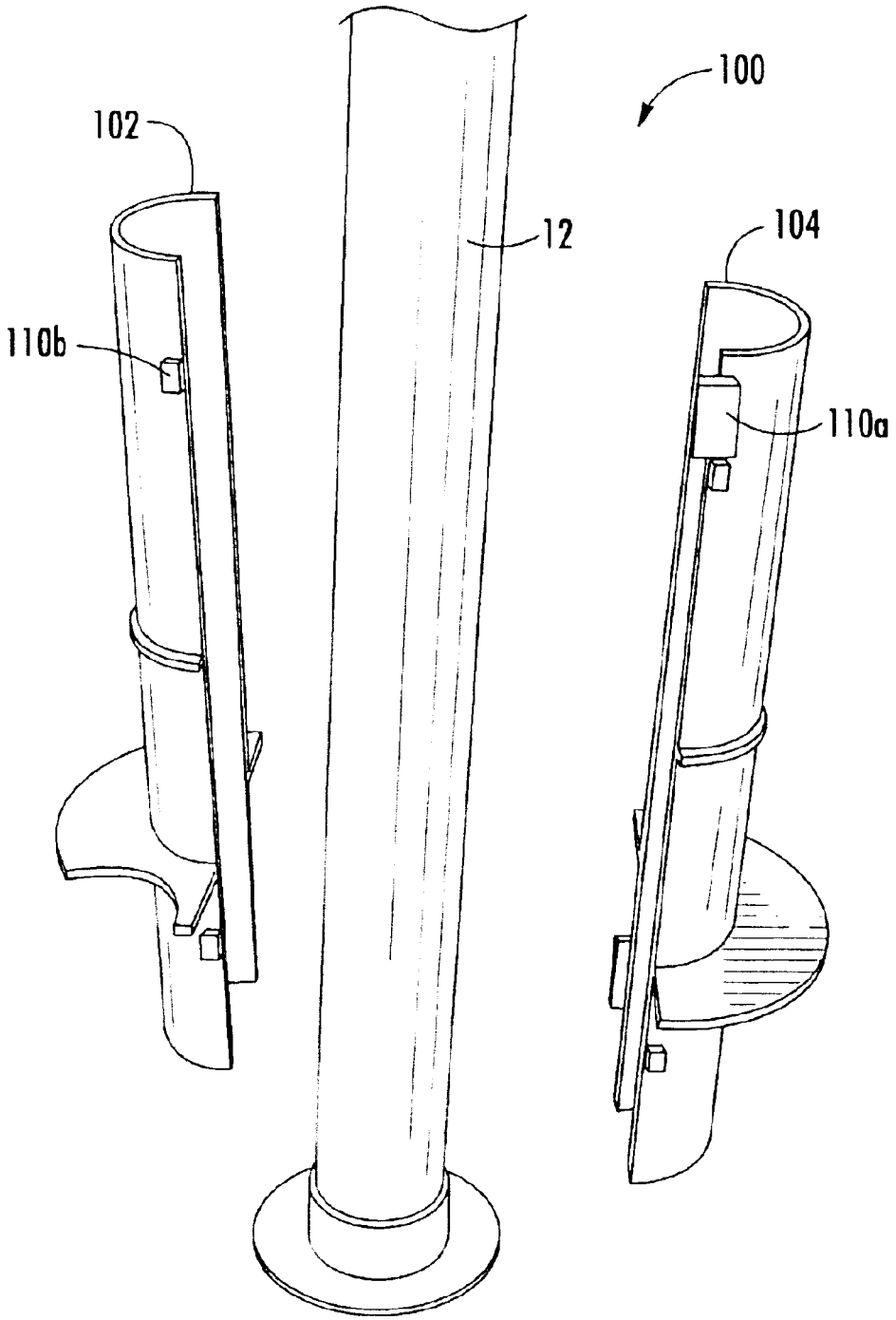
FIG. 4 is a schematic view of one split collar of the subject invention just prior to being coupled about an umbrella pole.
Figure 5:
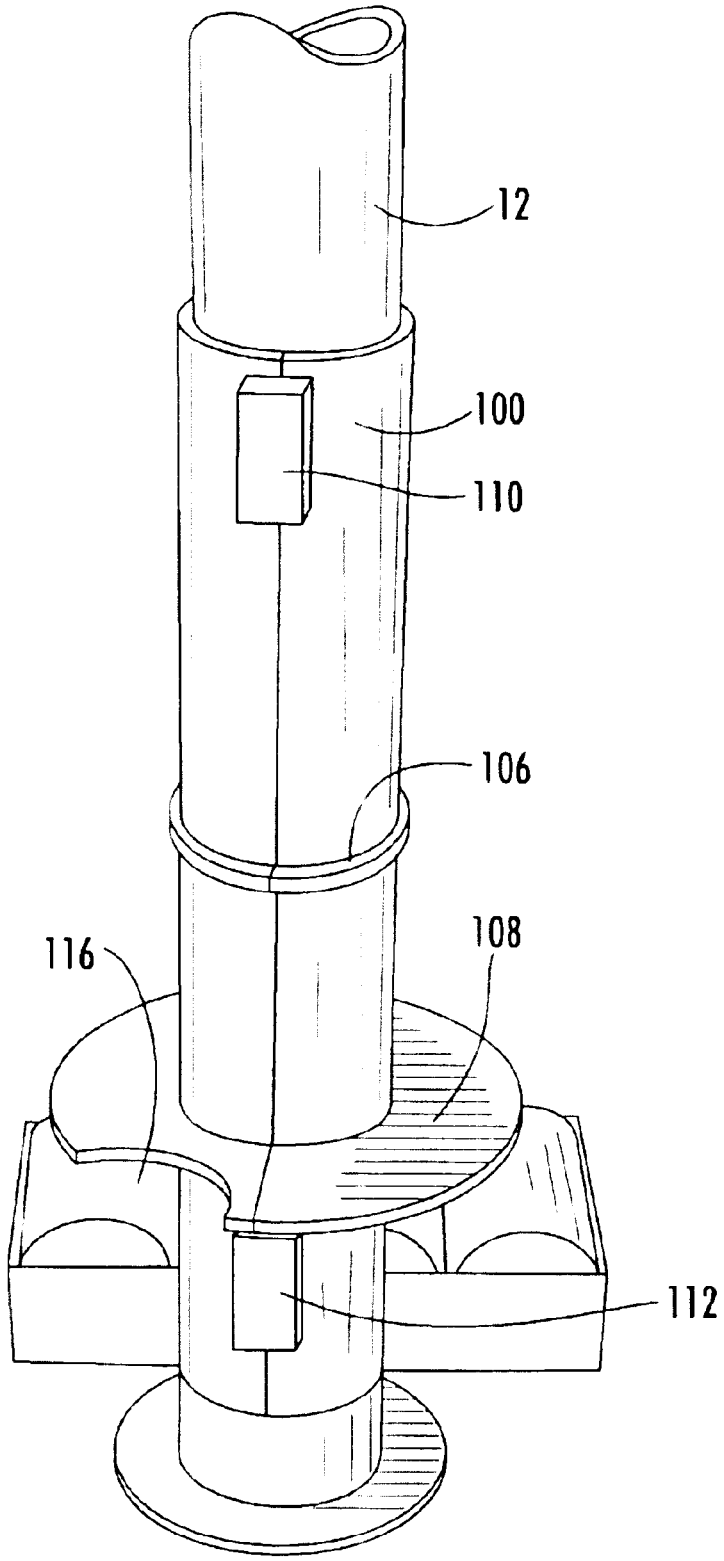
FIG. 5 is a schematic view of the split collar of FIG. 4 now assembled on the umbrella pole.

The prototype fan assembly in one embodiment of the subject invention features split collar 100, FIG. 4, typically in two sections 102 and 104 clampable about umbrella pole 12 as shown in FIG. 5. Split collar 100 includes drive ring support 106 preferably in the form of a circumferential lip extending outwardly from split collar 100 as shown and also motor housing support 108 typically in the form of a circumferential platform extending outwardly from split collar 100. Collar 100 can be made to fit a variety of umbrella poles by the inclusion of a foam sheath disposed between collar 100 and the umbrella pole to accommodate different diameter umbrella poles. Shims may also be provided to serve this purpose.

Upper clasp members 110 and lower clasp members 112 removably secure split collar 100 to pole 12. As shown in FIG. 1, section 104 includes one portion 110*a* of clasp member 112 and section 102 includes the other portion 110*b* of clasp member 110. There are typically two upper opposing clasp members 110, FIG. 5 and two lower opposing clasp members 112.

Figure 6:
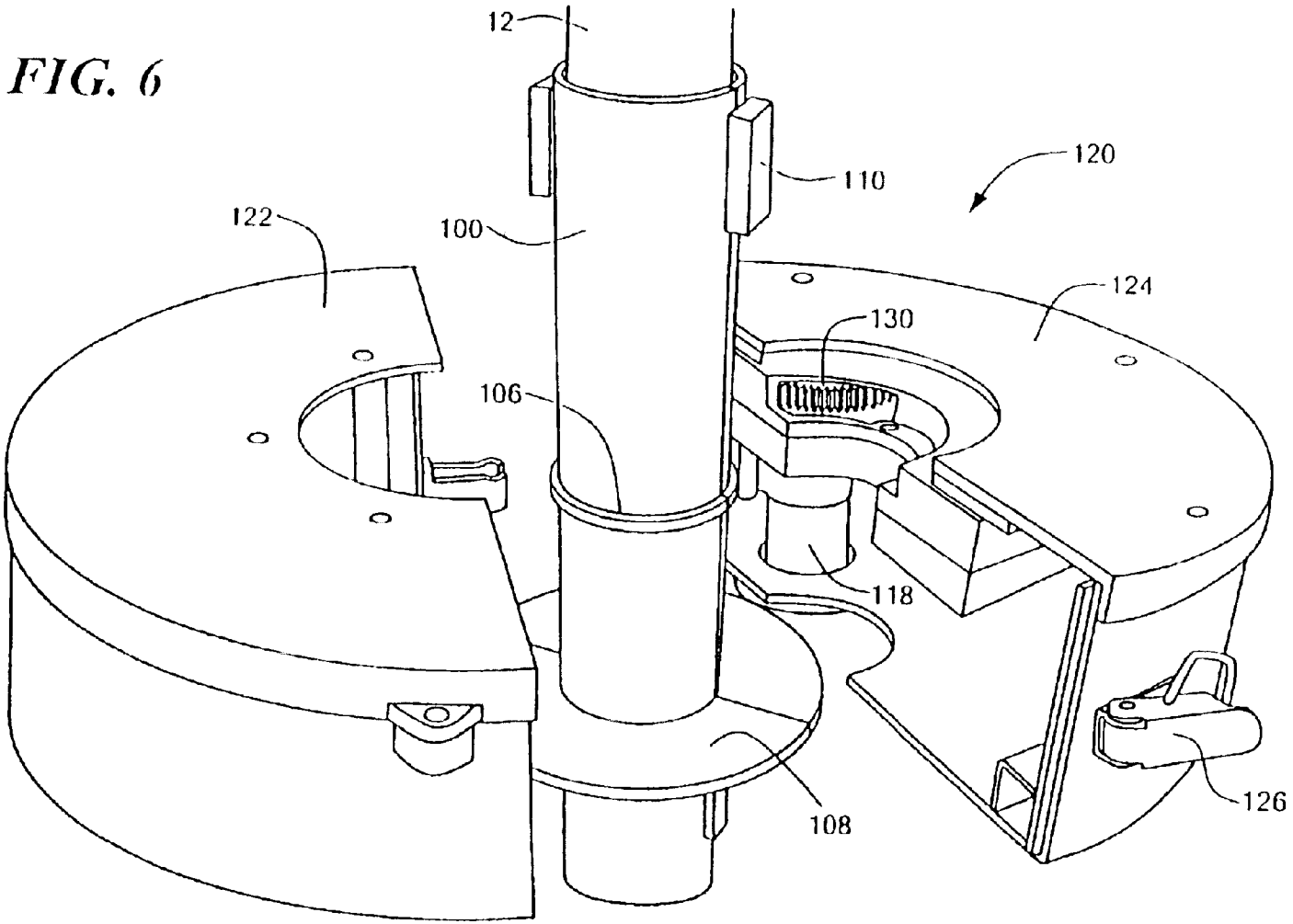
FIG. 6 is a schematic view of the preferred motor housing of the subject invention just prior to being coupled to the split collar.
Figure 7:
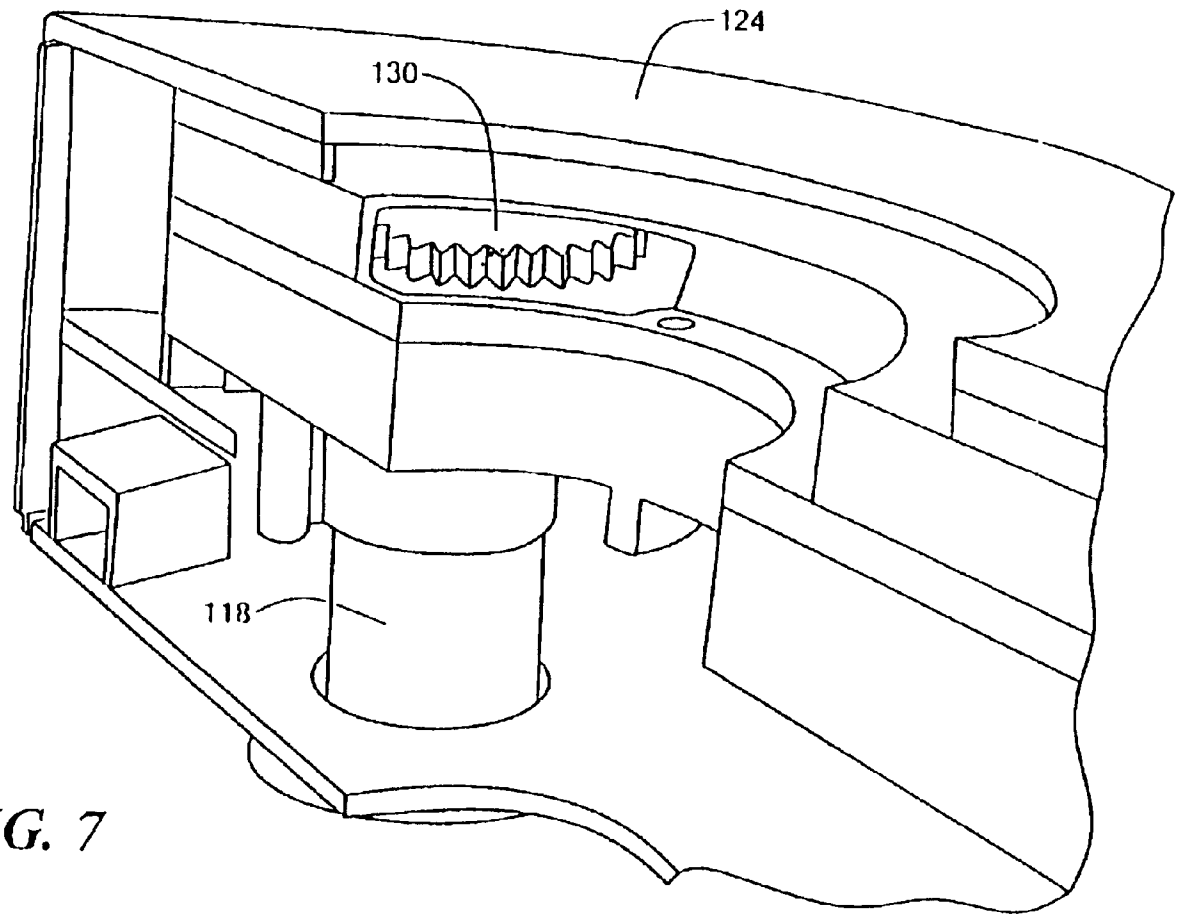
FIG. 7 is a partial schematic view of a motor housing drive gear of the subject invention.

Motor housing support platform 108 includes cutout 116 for motor 118, FIGS. 6–7 of the split motor housing 120. Split motor housing 120 is also typically formed in two sections 122, 124 each with two opposing clasp members 126. In this way, split motor housing 120 is removably clampable about split collar 100 and rests on motor housing support 108 thereof. Split motor housing 120 also includes a drive mechanism preferably in the form of drive gear 130 driven by battery powered DC motor 118 and positioned adjacent drive ring support 106 when split motor housing 120 is coupled to split collar 100 as shown in FIG. 8.

Figure 8:
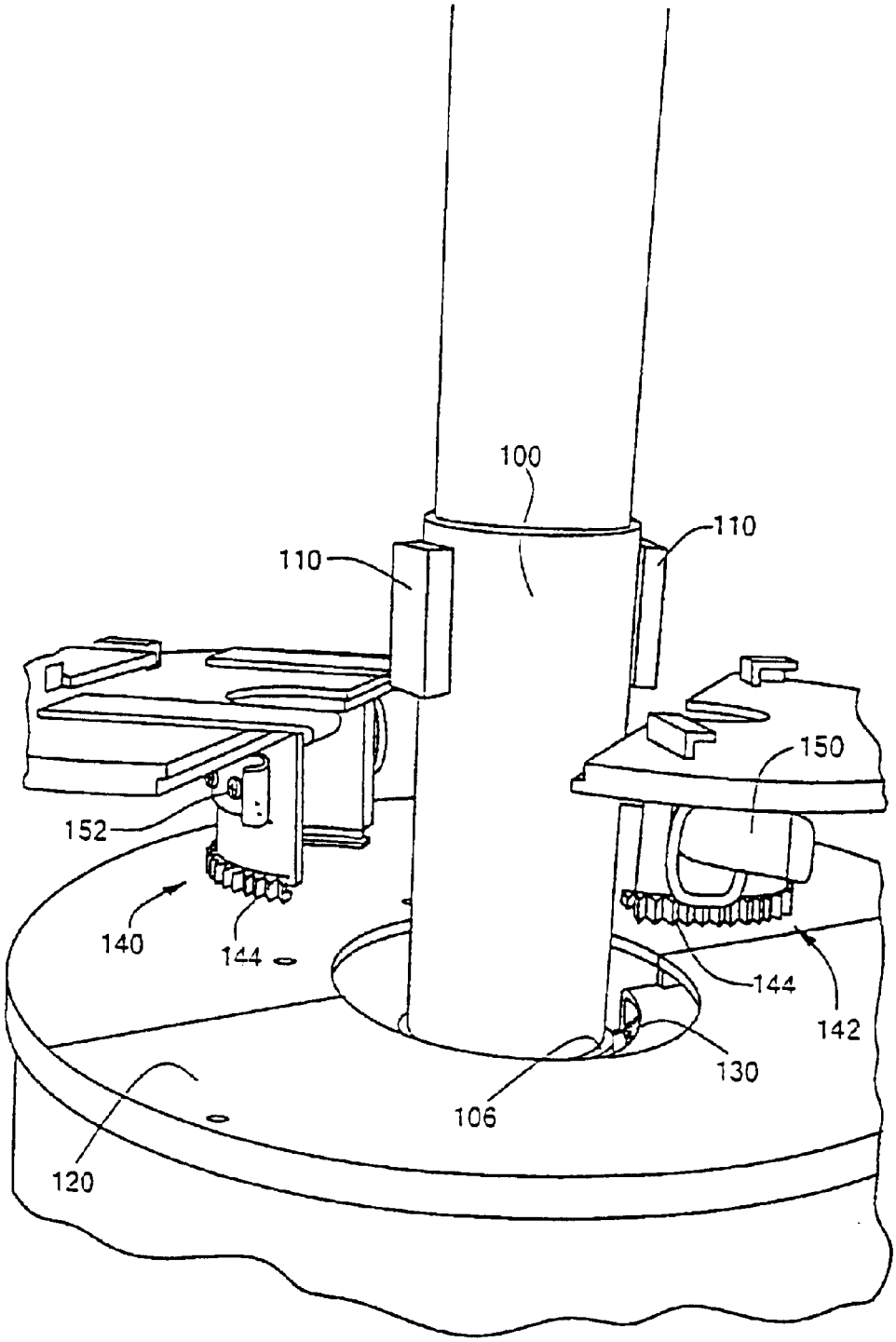
FIG. 8 is a schematic view of a fan blade split drive ring of the subject invention just prior to being rotatably coupled to the split collar shown in FIGS. 4–5.
Figure 9:
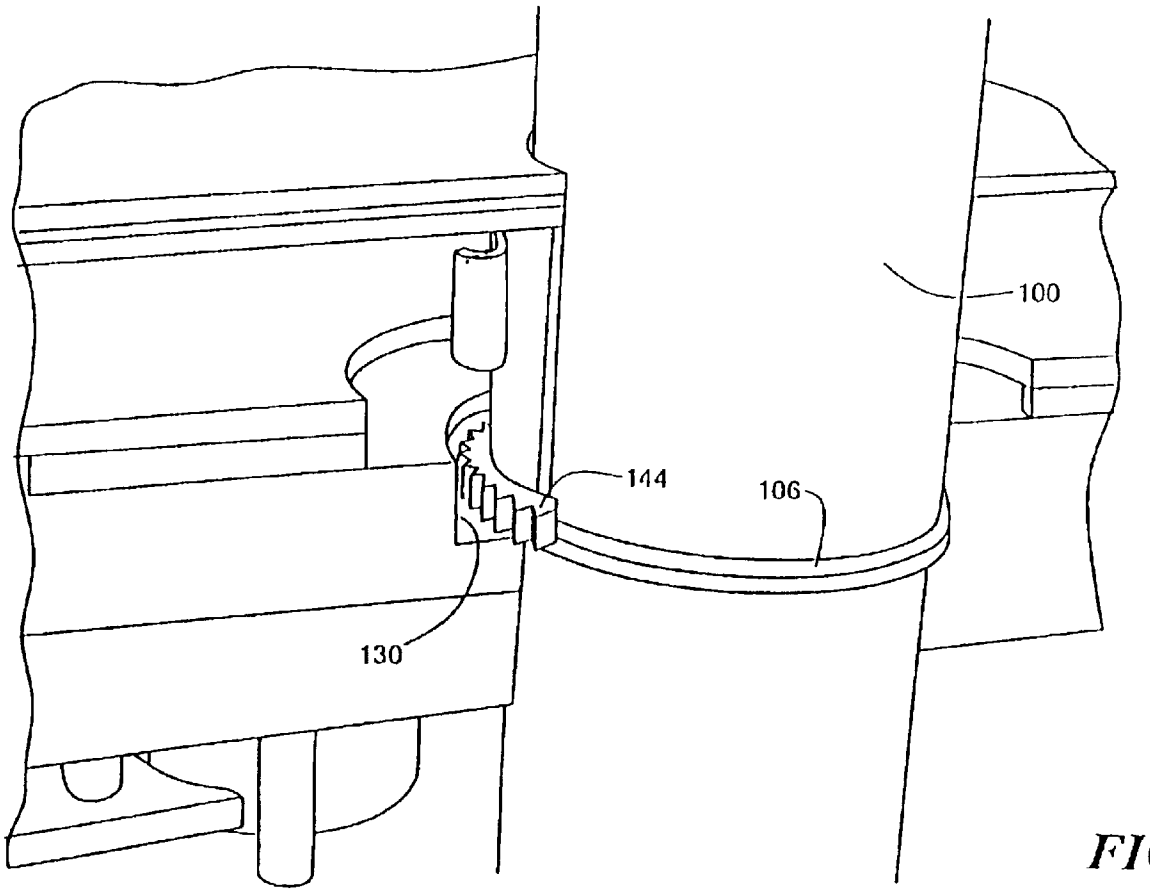
FIG. 9 is a partial schematic view showing the driven gear of the split drive ring of FIG. 8 resting on the split collar drive ring support and engaging the motor housing drive gear.

As also shown in FIG. 8, the split drive ring in one embodiment of the subject invention is preferably also in two sections 140, 142 rotatably clampable about split collar 100 and preferably including an integrated driven mechanism typically in the form of gear 144 extending downward as shown and rotatably supported on drive ring support 106 to mesh with drive gear 130, FIG. 9 of motor housing 120. Clasp members 150, 152, FIG. 8 and identical opposing clasp members removably secure split drive ring sections 140 and 142 together in a rotatable fashion about split collar 100.

Figure 10:
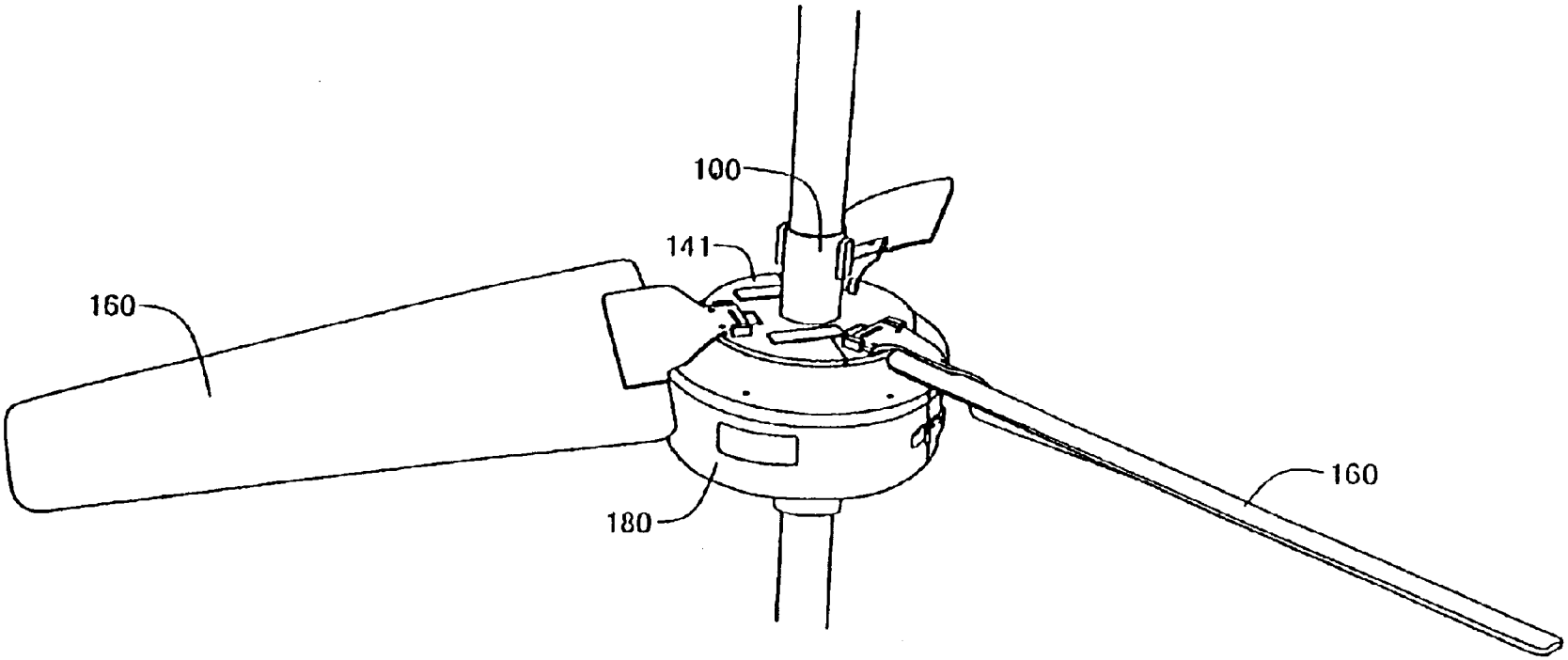
FIGS. 10–11 are schematic views of the complete prototype fan assembly of the subject invention.
Figure 11:
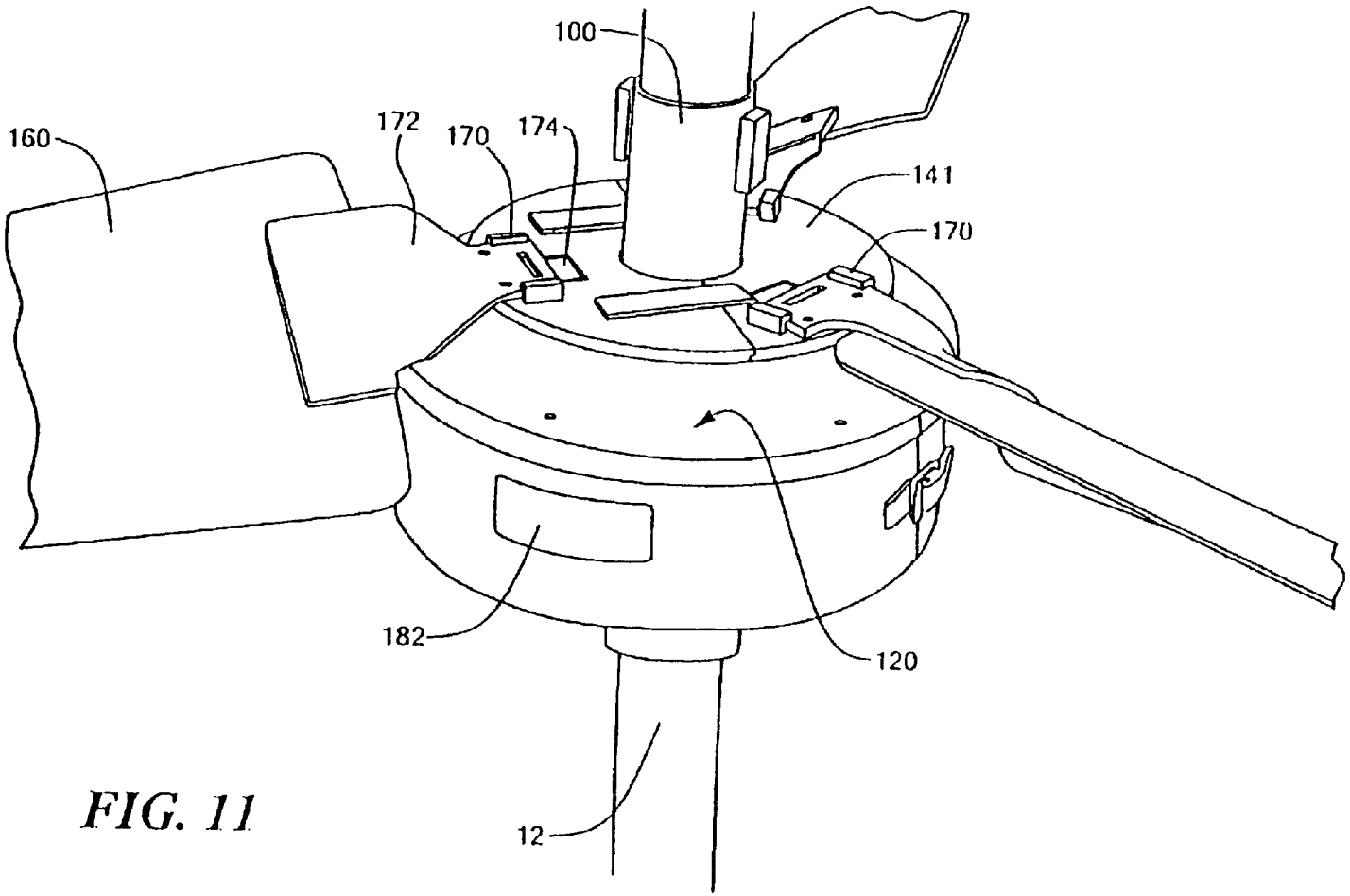

When fully assembled as shown in FIG. 10, split drive ring sections 140, 142, FIG. 8, form complete split drive ring 141, FIGS. 10–11, supported on and rotatable about split collar 100 and driven by the motor within split motor housing 120. Contoured fan blades 160 are coupled to split drive ring 141 preferably by three fan blade blocks 170, FIG. 11 on split drive ring 141 configured to releasably couple fan blades 160 to split drive ring 141. Preferably, each fan blade includes tang 172 received in fan blade block 170 configured to extend the fan blade out over the split motor housing. Tang 172 is also twisted as shown to angle the fan blades as shown in FIG. 11. Upwardly biased spring member 174 formed in the top surface of split drive ring 141 of each fan blade block releasably retains the distal end of each fan blade tang to split drive ring 141 via fan blade blocks 170.

In the prototype shown in FIG. 10, batteries 180 power motor 118, FIGS. 6–7, but, in the production version, six D-cell batteries 118 are typically housed internal to split motor housing 120 behind, for example, hinged door 182, FIG. 11.

Figure 12:
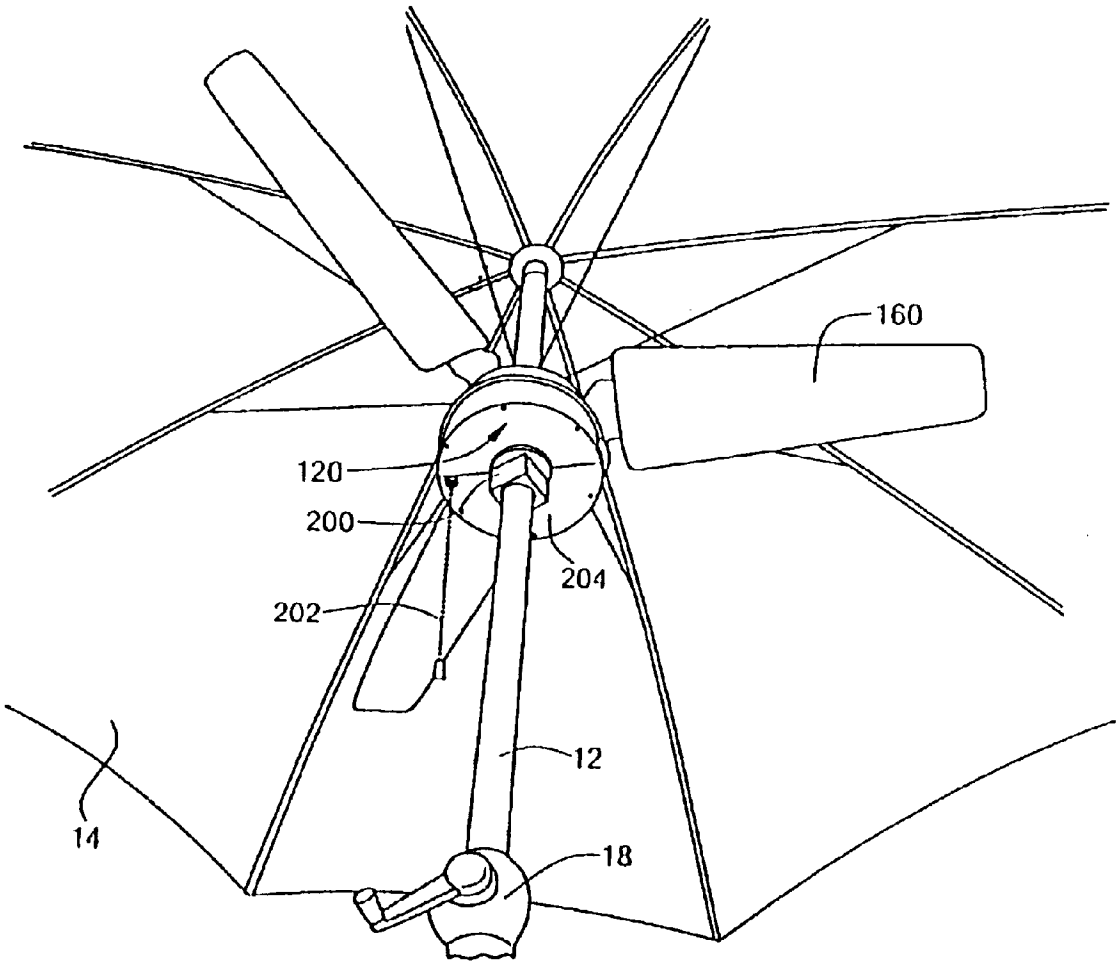
FIG. 12 is a schematic view of the fan assembly of this invention coupled to an umbrella pole.

FIG. 12 shows an embodiment of the subject invention attached to umbrella pole 12 between crank mechanism 18 and the slide for canopy 14. Pull string 202 activates the motor within housing 120 at three separate speeds and also activates a sound card which provides sounds such as birds chirping via speaker 204. Also, additional safety clamps 200 is provided to prevent the whole assembly from sliding down umbrella pole 12.

Figure 3:
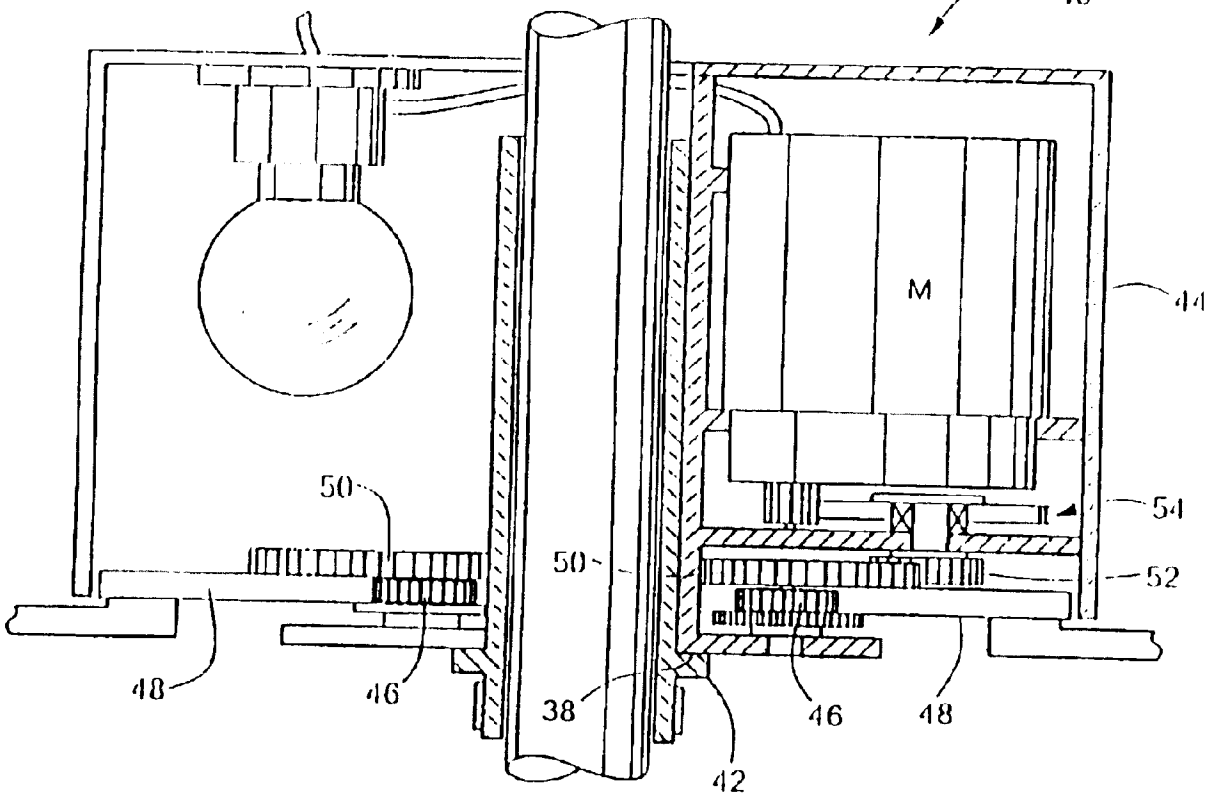
FIG. 3 PRIOR ART
FIG. 3 is a schematic cut away view of another prior art fan assembly.

Because drive gear 144, FIG. 9 of the drive ring is directly supported on drive ring support 106 of collar 100 and directly driven by motor housing drive gear 130, the need for complex and expensive bearings 46, FIG. 3, gear train 54, and large rotatable drive ring drive gear 50 are eliminated resulting in a much simpler, easier to manufacture, and easier to assemble and disassemble after-market umbrella fan assembly.

The fan assembly of the subject invention can be made primarily of plastic components and can thus be sold at a low cost. The fan assembly shown in the figures is universal in design and can be configured to accommodate different umbrella pole diameters and a variety of umbrella configurations. By decoupling clasp members 110, FIG. 5 of the split collar, the complete assembly can be easily slid down the umbrella pole when the umbrella canopy is folded down and not in use and then also easily slid back up the umbrella pole and into position when the umbrella canopy is deployed. During the winter months, the complete fan assembly can be quickly disassembled and stored. Also, fan blades 160, FIG. 11, are easily removed and in this way the umbrella canopy may even be folded down over the fan assembly once the fan blades are removed therefrom. Because the fan assembly is battery operated, it is convenient to use and moreover multiple drive pinions, special gear keys, and bearing assemblies are not required. The result is a self contained, universal, and low cost, umbrella fan assembly which is easy to assemble and which can also be quickly moved down or decoupled from the umbrella pole when the umbrella canopy is folded down.

Figure 13A:
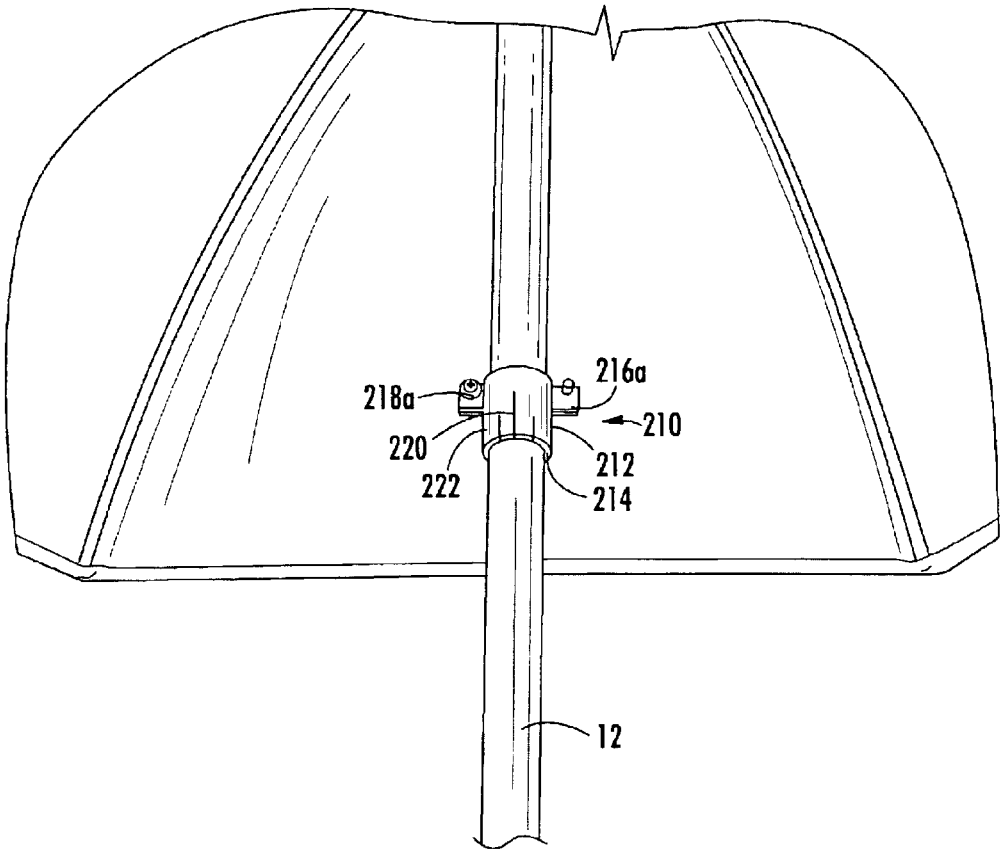
FIG. 13A is a schematic view of a lower coupling used in another embodiment of the subject invention.
Figure 13B:
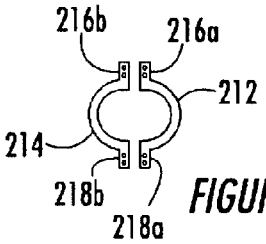
FIG. 13B is a top view of the lower coupling of FIG. 13A.
Figure 14:
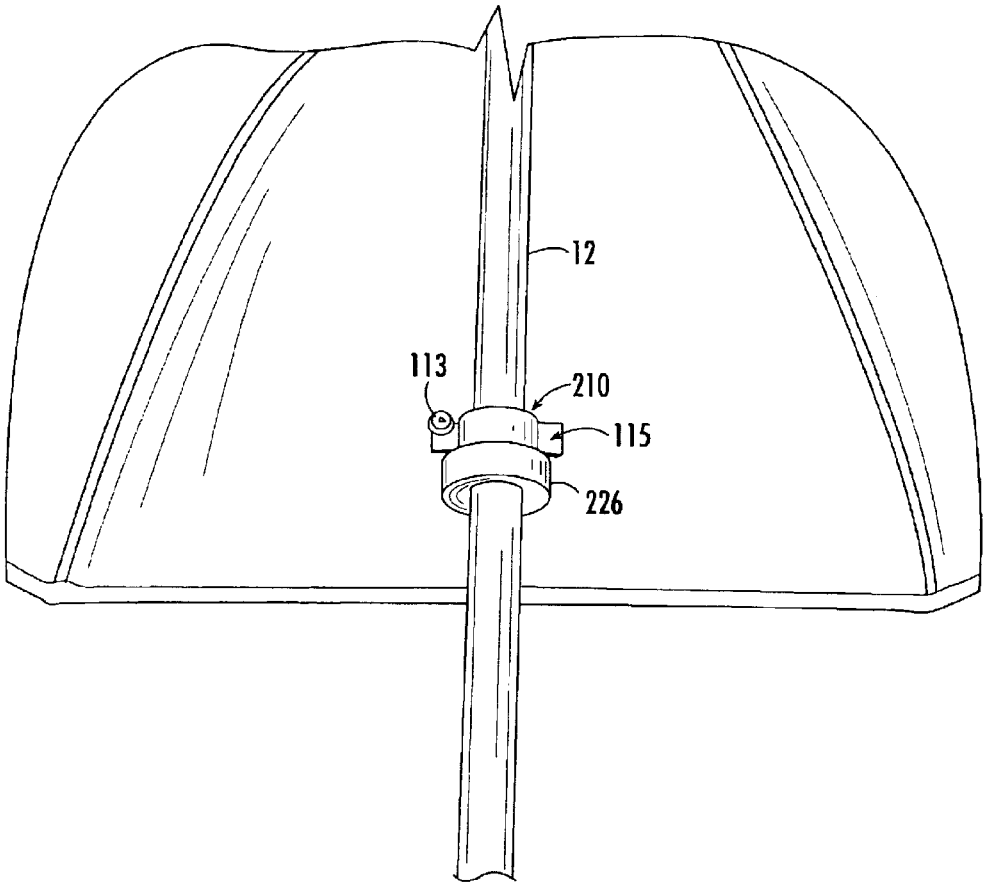
FIG. 14 is a schematic view of the nut of the lower coupling of FIG. 13.

In another embodiment, coupling 210 is provided in two sections 212 and 214 which are clampable about umbrella pole 12 as shown in FIG. 13A. Each section 212, 214 of coupling 210 has two clasp members 216*a*, 216*b* and 218*a*, 218*b*, respectively, FIG. 13B, and fasteners 113 and 115 for securing coupling 210 about the pole 12. Coupling 210 also has two or more slits 220 located on the lower portion of coupling 210 such that one or more fingers 222 are formed. Fingers 222 can be threaded. Each of the fingers 222 is tapered such that nut element 226, FIG. 14, is engaged to coupling 210 for taper fitting and securing the collar to pole 12. Nut 226 can be hinged to fit about collar 210 and can be non-threaded to fit collar 210 or alternatively can be threaded.

Figure 15:
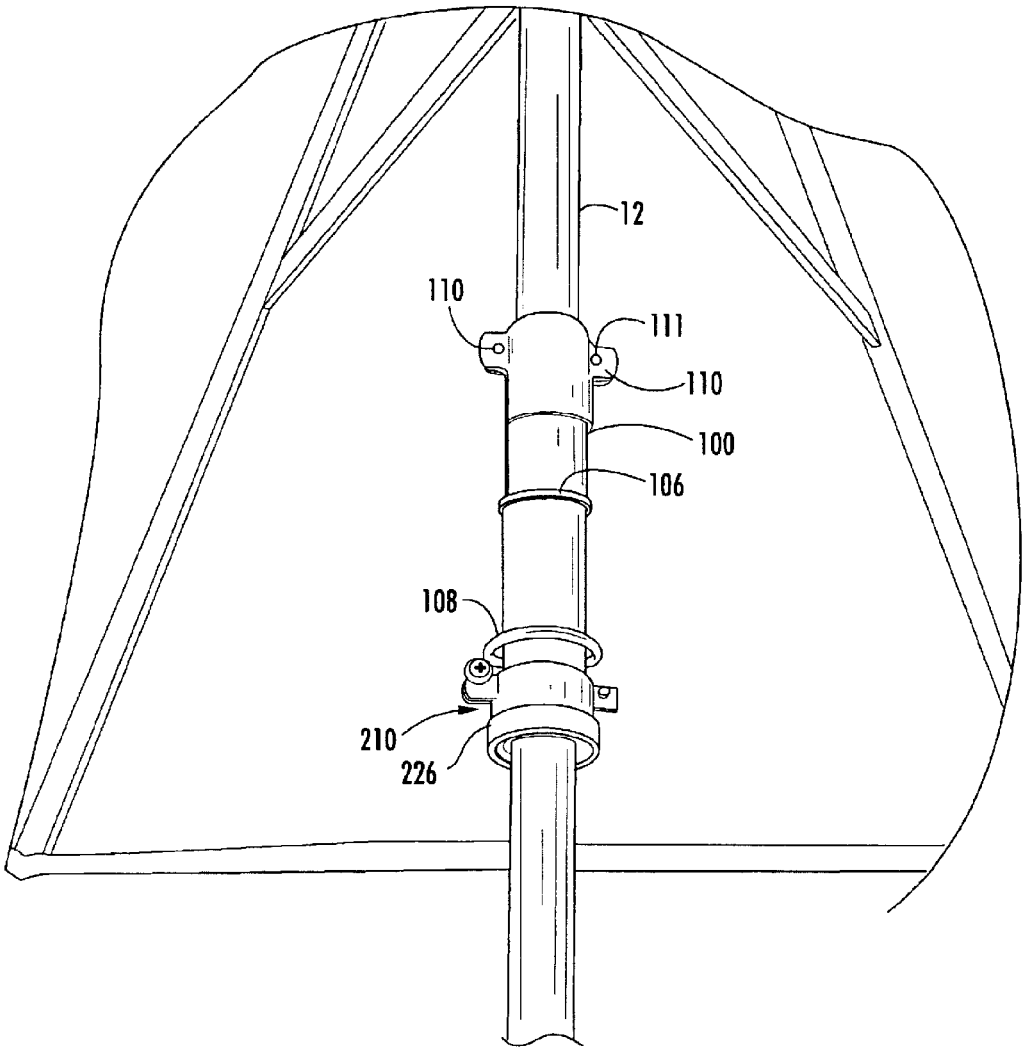
FIG. 15 is a schematic view of a collar being assembled about the umbrella pole and supported by the coupling of FIG. 14.
Figure 16:
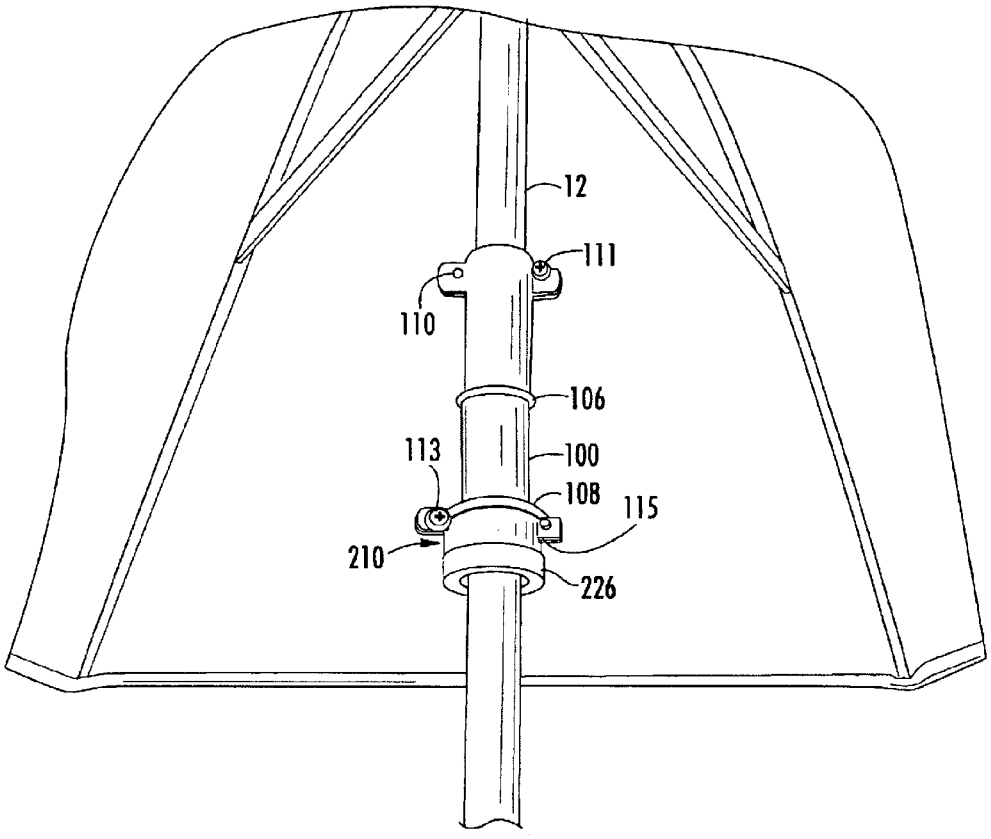
FIG. 16 is a schematic view of the collar fully assembled above the coupling.

Once the lower coupling 210 and nut 226 are fitted to the umbrella pole 12, split collar 100, FIGS. 15–16, can be clamped about umbrella pole 12 and secured using upper clasp members 110 and 111. With the use of lower collar 210 and nut 226, collar 100 can be loosely fit to umbrella pole 12 such that collar 100 is supported by lower coupling 210. In this way, by merely loosening fasteners 113 and 115, the whole fan assembly can be slid down pole 12.

Figure 17:
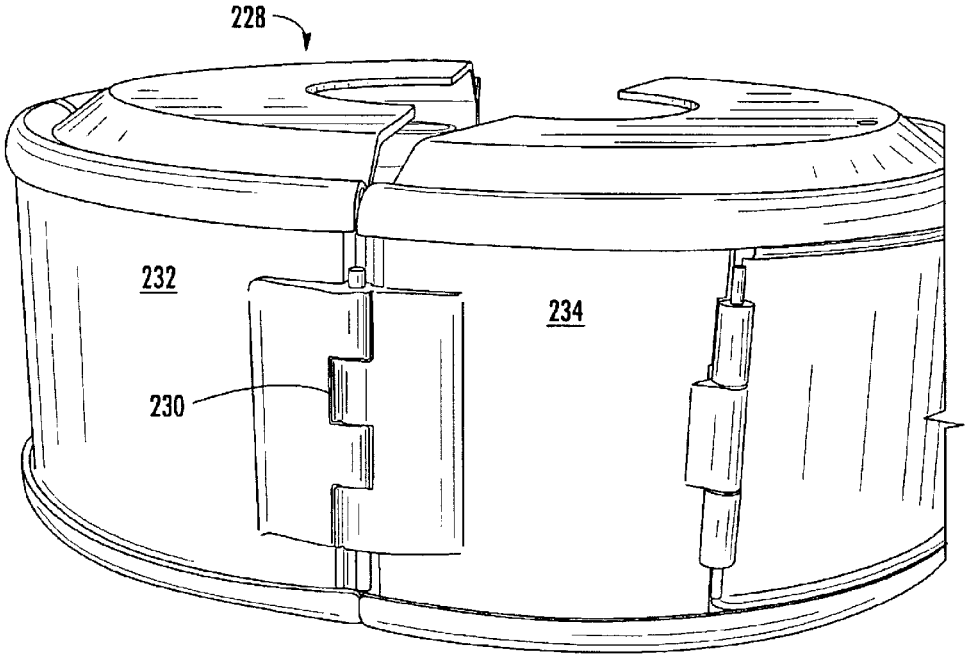
FIG. 17 is a schematic view of the split motor housing of this invention.
Figure 18:
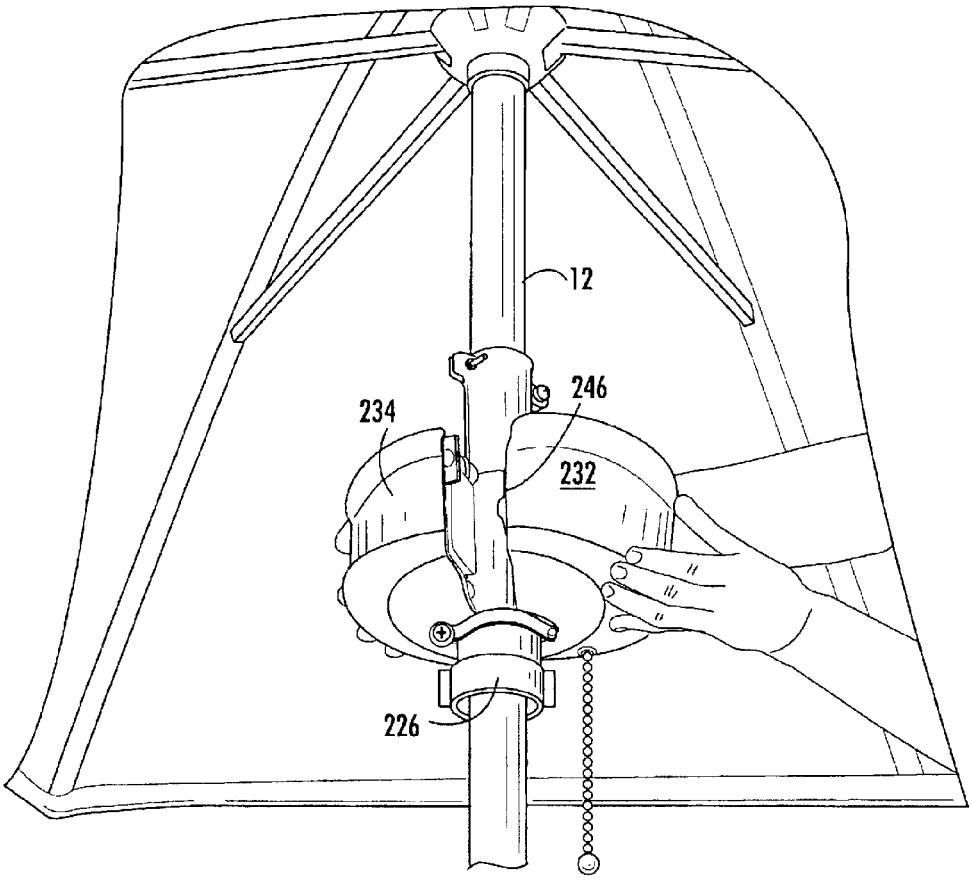
FIG. 18 is a schematic view showing the split motor housing being coupled to the collar of FIG. 16.

Motor housing 228, FIG. 17, includes hinge 230 that joins first and second sections 232 and 234. Hinge 230 allows a consumer to easily assemble split motor housing 228 about split collar 100 as shown in FIG. 18 to rest on motor housing support 108, FIGS. 15–16.

Figure 19:
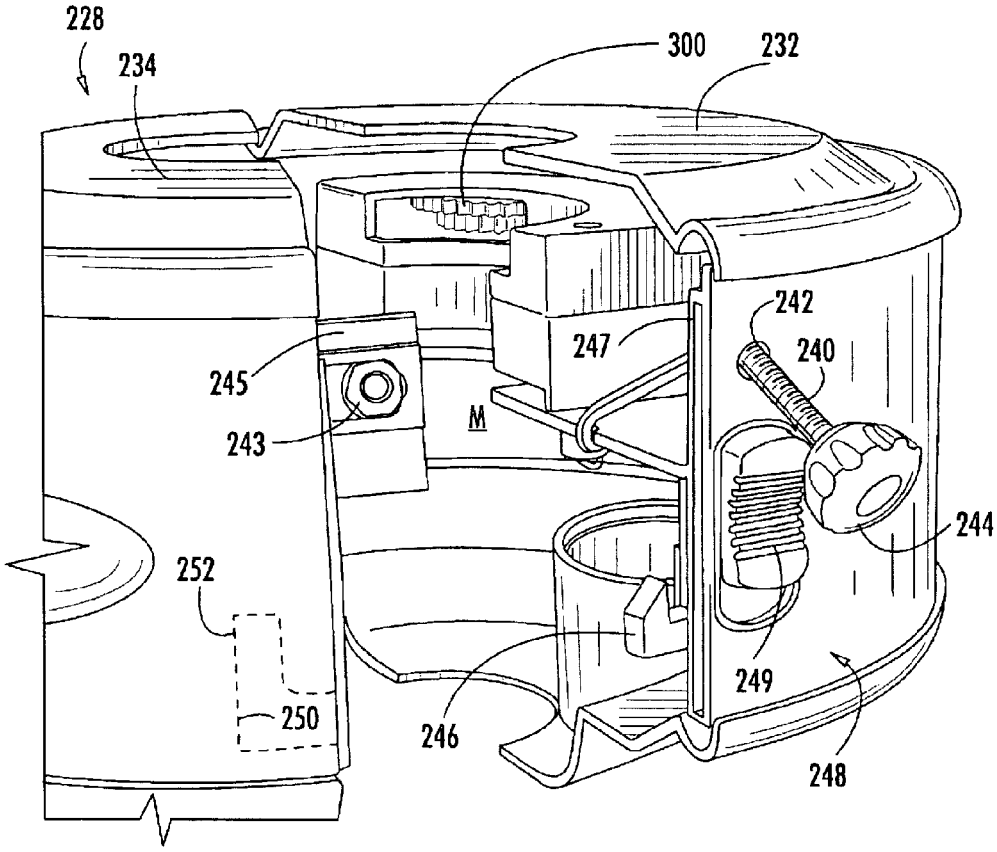
FIG. 19 is a schematic view of the interior of the split motor housing of FIG. 17.

Split motor housing 228, FIG. 19, also includes one or more features for locking or clamping split sections 232 and 234 together. For example, section 232 of the motor housing 228 has hole 242 that accepts a screw 240 which screws into screw hole 243 located on section 234 of the motor housing. Screw 240 includes handle 244 for easy insertion and removal of screw 240 into screw hole 243. Screw hole 243 is located on a tang 245 protruding from section 234 of housing 228. Housing section 232 has cavity 247 configured to receive tang 245 when the two sections 232 and 234 are clamped together about umbrella pole 12 as shown in FIG. 18. When the two section of the motor housing 232 and 234 are coupled together about umbrella pole 12, screw 240 can be inserted in hole 242 and screwed into screw hole 223 to lock the two split sections of the motor housing about umbrella pole 12.

Motor housing 228 also has a sliding lock 248, FIG. 19, that includes a sliding button 249 and a sliding clasp 246, which are located on section 232 of the motor housing, and a cavity 250 located in section 234 of the motor housing. When the sliding button 249 is in a first position, sections 232 and 234 of motor housing 228 can be coupled together about umbrella pole 12. When split sections 232 and 234 are coupled together, moving the slidable button 248 from the first position to the second position locks the sliding lock. Cavity 250 in motor housing section 234 accepts sliding clasp 246 when sliding button 248 is in the first position and is configured to accept sliding clasp 246 in portion 252 of cavity 250 when the sliding button is in the second position in which sections 232 and 234 of motor housing 228 are locked or clamped together.

Figure 20:
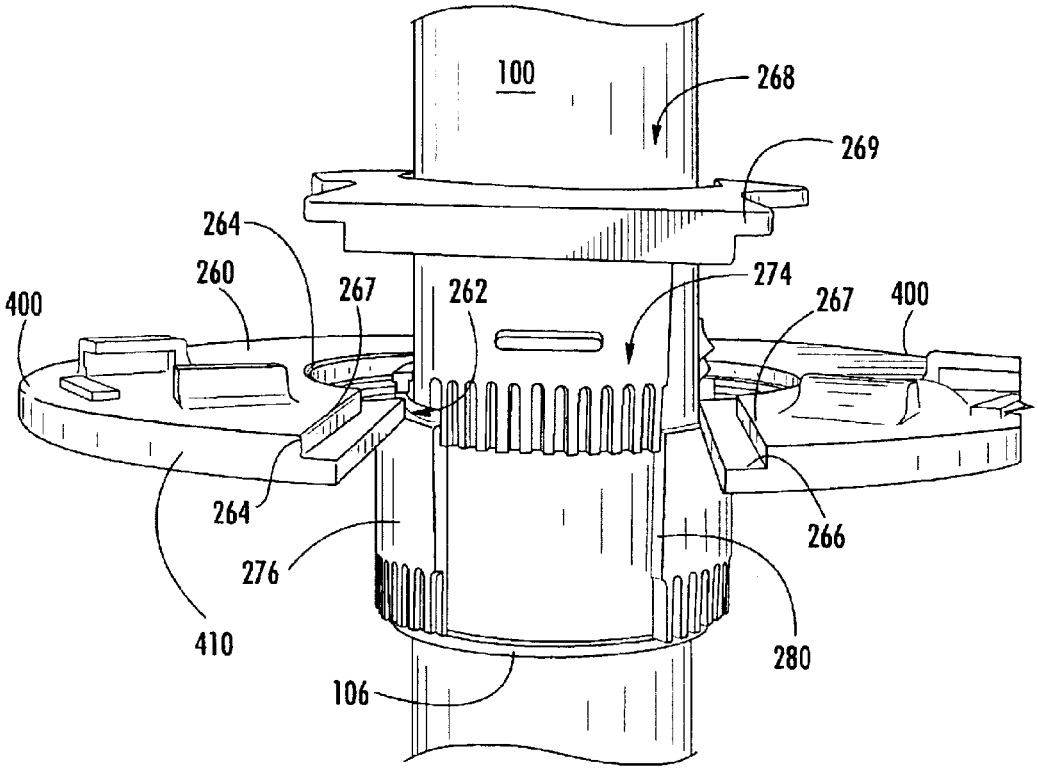
FIG. 20 is a schematic view showing the assembly of the drive ring about the collar.
Figure 21:
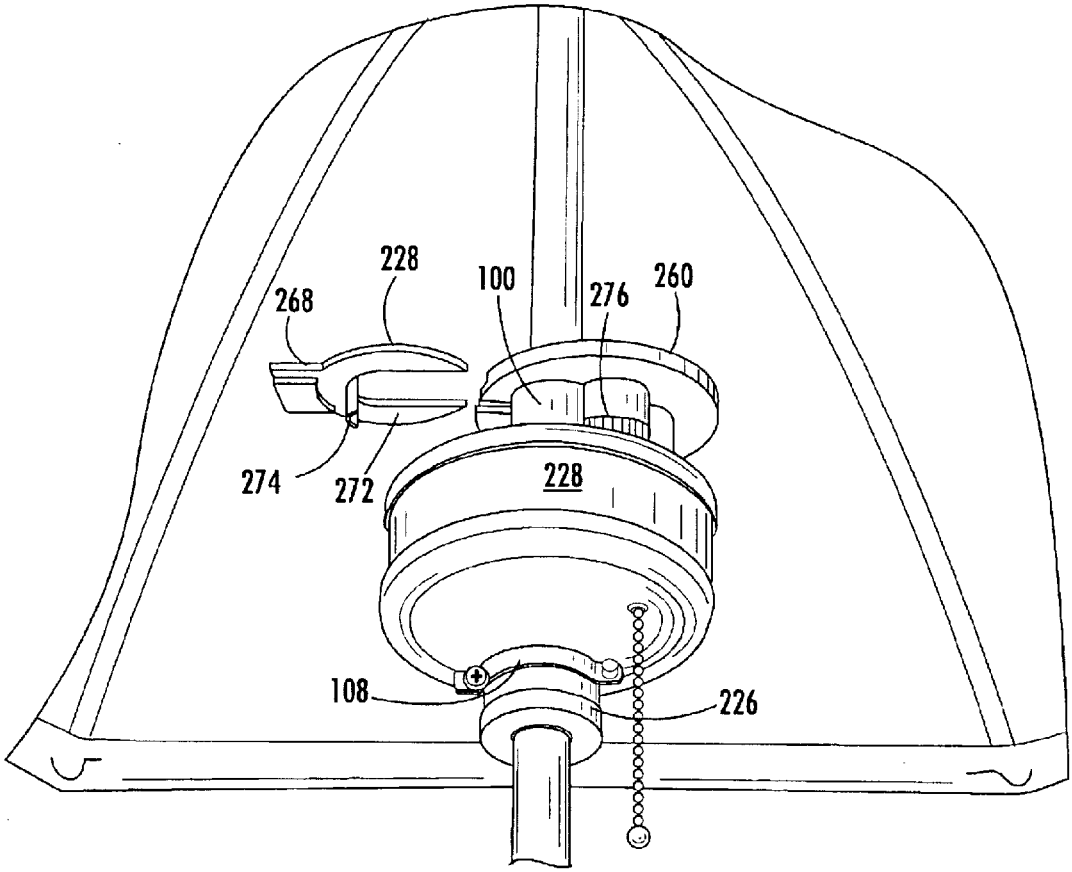
FIG. 21 is a schematic view of the drive ring of FIG. 20 and a drive ring key of the invention.

Drive ring 260, FIGS. 20–21 in this embodiment, includes slot 262 configured such that drive ring 260 can slidingly engage collar 100 to be rotatably supported by drive ring support 106, FIGS. 16 and 20. Drive ring 260 includes two side grooves 264 and 266 configured to receive drive ring key 268, FIG. 21. Drive ring 260 also includes a driven gear portion 276 and a slot 280 configured to accept a driven gear key portion 274 of drive ring key 268. Drive ring key 268 has two circular sections 270 and 272 configured to fit circular insert 272, FIG. 20, in drive ring 260.

Drive ring key 268, FIG. 21, also includes a driven key portion 274 that is located adjacent to driven gear section 276 of drive ring 260 when drive ring key 268 is inserted into drive ring 260. When drive ring key 268 and drive ring 260 are coupled together about collar 100 such that circular inserts 270 and 272 are placed in circular insert 269 of drive ring 260, a locking fit is provided between the drive ring and drive ring key. Thus, in this embodiment, drive ring 260 includes plate 400 extending outward from collar 100 and lower gear 276 closely spaced to collar 100 and supported by support 106. The other section of drive ring 260, namely key 168, completes plate 400 and lower gear 276. In this way, portion 410 of drive ring 260 circumferentially surrounds the majority of collar 100.

To provide a locking fit between drive ring 260 and key 268, drive ring 260 includes one or more recesses 267 adjacent to either or both grooves 264 and 266 configured to accept one or more corresponding clips 269 on drive ring key 268. Clips 269 may be of the type typically found on consumer electronics battery compartment doors. Each clip 269 will engage its corresponding recess 267 when drive ring key 268 is pressure fitted to drive ring 260. Alternatively, slide mechanisms can secure key 268 with respect to the other portion of drive ring 260.

Figure 22:
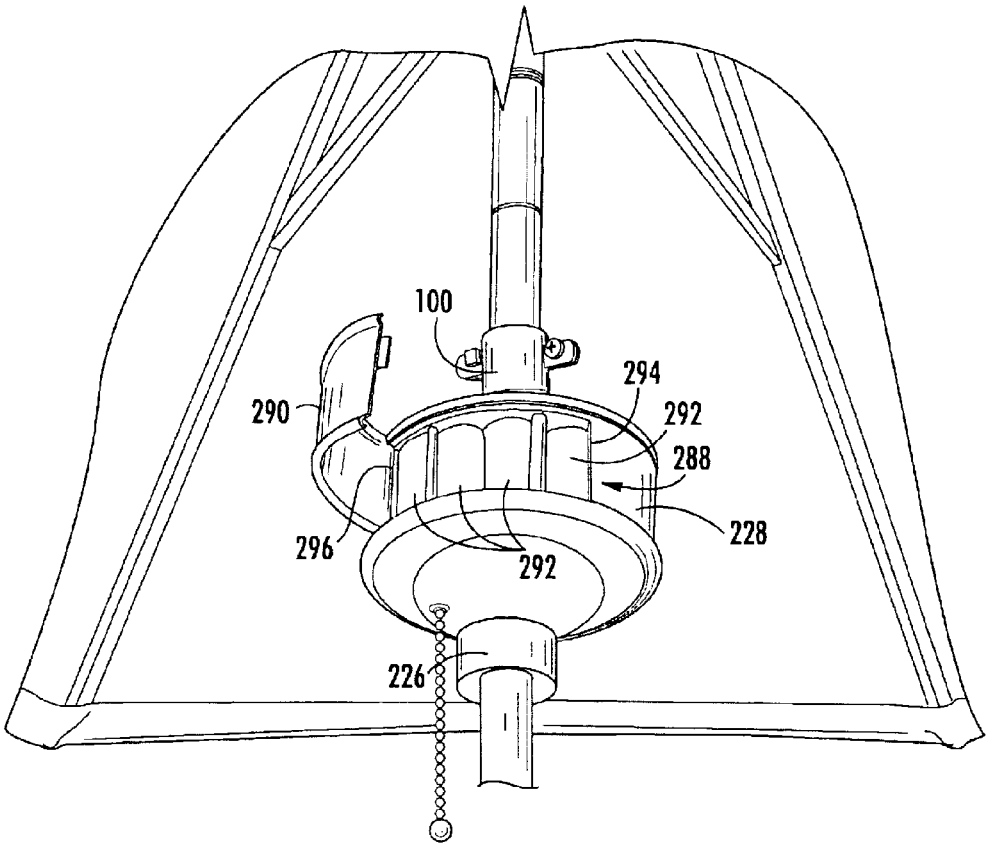
FIG. 22 is a schematic view of the battery compartment of the split motor housing of FIG. 17.

Motor housing 228, FIG. 22, includes battery compartment 288 and a battery compartment door 290 to house one or more batteries 292 for providing electricity to motor M, FIG. 19. Motor M rotates a drive mechanism such as drive gear 300. Drive gear 300, in turn, engages driven gear 276 of drive ring 260, FIGS. 20–21. Battery compartment 229 is subdivided into one or more subcompartments 294 for containing individual batteries 292. Compartment door 290 includes a hinge 296 coupled to motor housing 228 for easily opening the compartment door.

Figure 23:
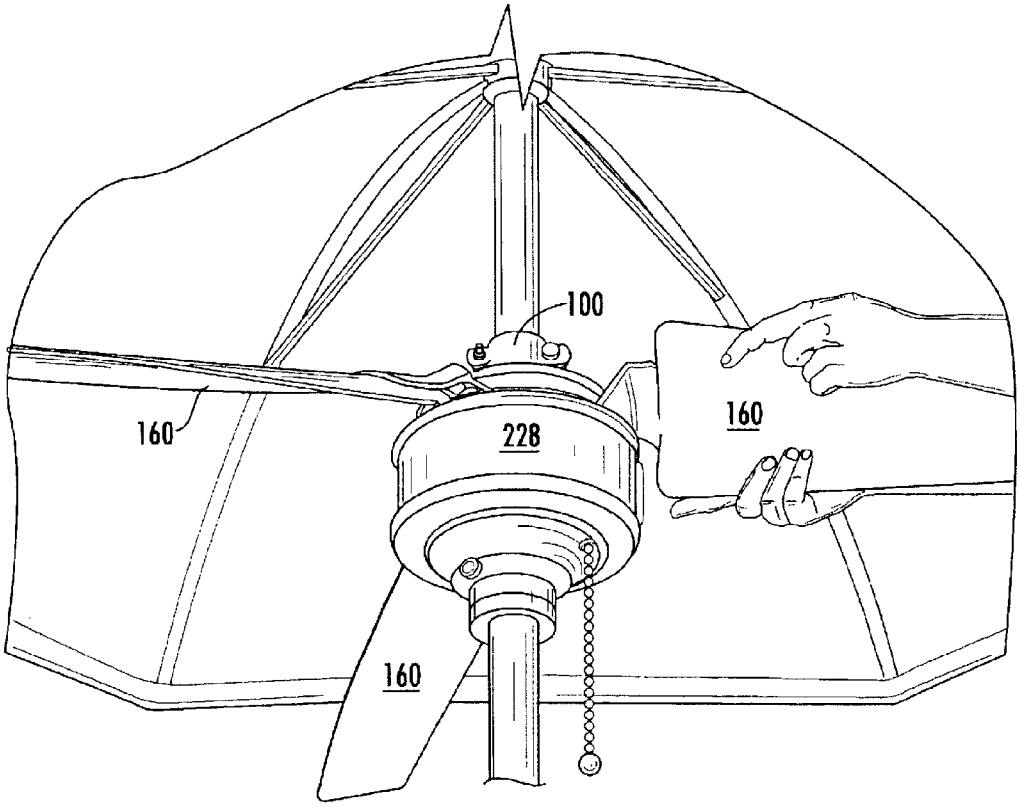
FIG. 23 is a schematic view of the split motor housing of FIG. 17 with the fan blades assembled.

Fan blades 160, FIG. 23, are inserted into drive ring 260 to secure the fan blades. Each fan blade 160 includes a tang (see FIG. 11), which is received in a fan blade block located on the drive ring 260.

Figure 24:
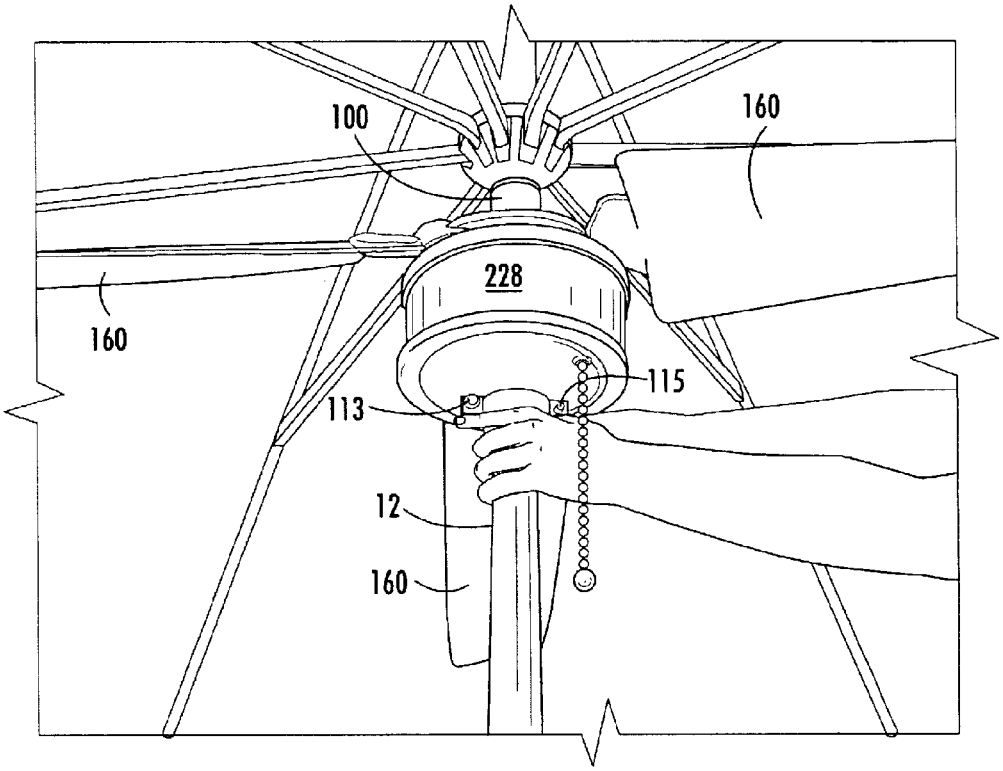
FIGS. 24–25 are schematic views of the split motor housing of FIG. 23 with the split motor housing raised up the umbrella pole.
Figure 25:
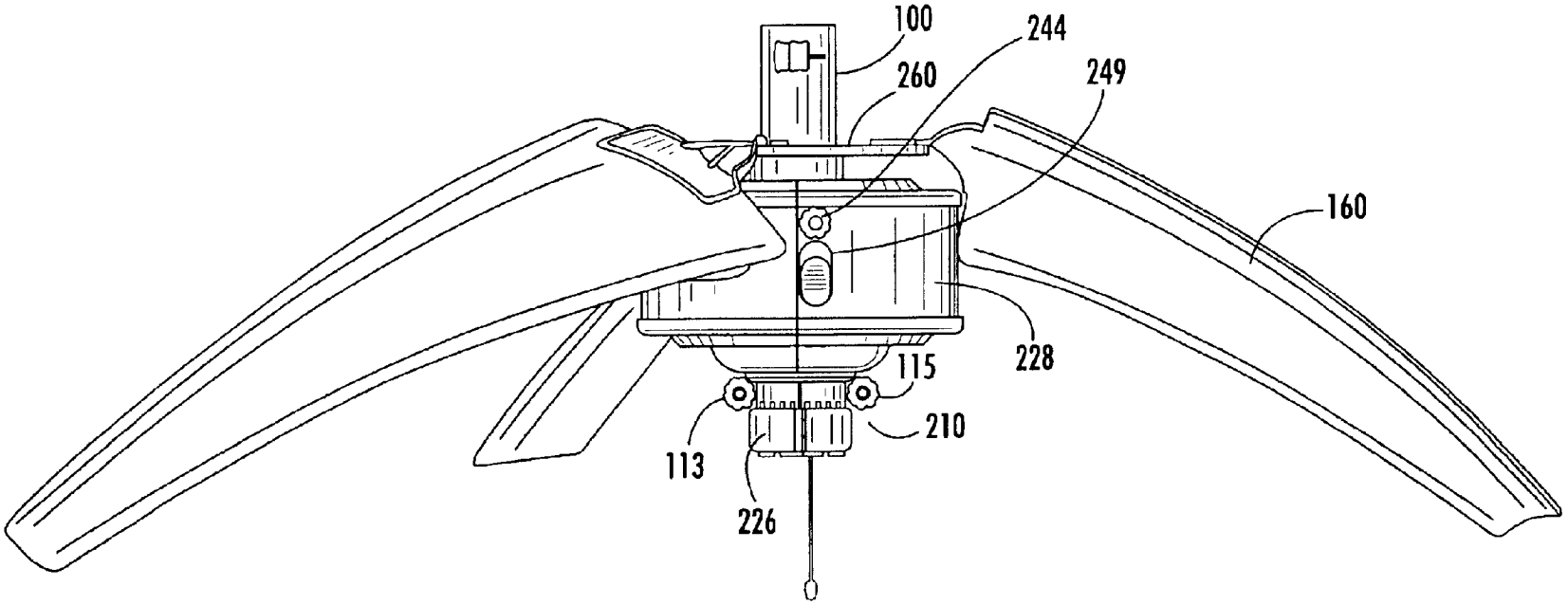

Once the fan is assembled, the complete fan assembly can be manually raised and lowered up and down the umbrella pole 12, FIG. 24, by loosening fasteners 113 and 115 and raising the split collar, the motor housing 228, and the drive ring up the umbrella pole. Fan blades 160 can be easily removed and the umbrella can be closed and stored while the fan assembly is still attached to the umbrella pole. In this manner, the umbrella can be easily stored without disassembling the fan assembly 326. Thus, it is easy for a consumer to use and store the fan assembly.

Although specific features of the invention are shown in some drawings and not in others, however, this is for convenience only as each feature may be combined with any or all of the other features in accordance with the invention. The words "including", "comprising", "having", and "with" as used herein are to be interpreted broadly and comprehensively and are not limited to any physical interconnection. Moreover, any embodiments disclosed in the subject application are not to be taken as the only possible embodiments. For example, the sub-assemblies disclosed herein may be hingable about the umbrella pole and/or include a slot which receives the umbrella pole therein.

Other embodiments will occur to those skilled in the art and are within the following claims:

What is claimed is:

1. A fan assembly fastenable about a pole, the fan assembly comprising:

a collar clampable about the pole and including a drive ring support disposed above a motor housing support;

a motor housing clampable about the collar to rest on the motor housing support, the motor housing including a drive mechanism;

a drive ring in two sections disposed about the collar to rotatably rest on the drive ring support of the collar, the drive ring including a driven mechanism driven by the drive mechanism of the motor housing; and a plurality of fan blades coupled to the drive ring.

2. The fan assembly of claim 1 further including a coupling clampable about the pole beneath the collar to support the collar on the pole.

3. The fan assembly of claim 1 wherein the drive ring includes a plate extending outward from the collar and the driven mechanism includes a lower gear closely spaced to the collar and driven by the drive mechanism of the motor housing.

4. The fan assembly of claim 1 wherein a first section of the drive ring circumferentially surrounds the majority of the collar and the second section of the drive ring is a key which completes the drive ring.

5. The fan assembly of claim 1 in which the coupling includes a nut for securing the coupling to the pole.

6. The fan assembly of claim 1 wherein the motor housing is in two sections hinged together.

7. The fan assembly of claim 1 wherein the motor housing includes at least one locking mechanism to clamp the hinged motor housing sections together about the pole.

8. The fan assembly of claim 7 wherein the at least one locking mechanism includes a sliding clasp for securing the two sections of the hinged motor housing together.

9. The fan assembly of claim 7 wherein the at least one locking mechanism includes a fastener extending through the two sections of the hinged motor housing.

10. A fan assembly fastenable about a pole, the fan assembly comprising:

a collar clampable about the pole and including a drive ring support disposed above a motor housing support;

a motor housing clampable about the collar supported by the motor housing support, the motor housing including a drive mechanism;

a drive ring in two sections disposed about the collar and supported by the drive ring support of the collar, a first section of the drive ring circumferentially surrounding the majority of the collar, the second section of the drive ring being a key that completes the drive ring, the drive ring including a driven mechanism driven by the drive mechanism of the motor housing; and a plurality of fan blades coupled to the drive ring.

11. The fan assembly of claim 10 further including a coupling clampable about the pole beneath the collar to support the collar on the pole.

12. The fan assembly of claim 11 wherein the drive ring includes a plate extending outward from the collar and the driven mechanism includes a lower gear closely spaced to the collar and driven by the drive mechanism of the motor housing.

13. A fan assembly fastenable about a pole, the fan assembly comprising:

a collar clampable about the pole and including a drive ring support disposed above a motor housing support;

a coupling clampable about the pole beneath the collar to support the collar on the pole;

a motor housing clampable about the collar supported by the motor housing support, the motor housing including a drive mechanism;

a drive ring in two sections disposed about the collar rotatably supported on the drive ring support of the collar, the drive ring including a driven mechanism driven by the drive mechanism of the motor housing; and a plurality of fan blades coupled to the drive ring.

14. The fan assembly of claim 13 wherein the drive ring includes a plate extending outward from the collar and the driven mechanism includes a lower gear closely spaced to the collar and driven by the drive mechanism of the motor housing.

15. The fan assembly of claim 13 wherein a first section of the drive ring circumferentially surrounds the majority of the collar and the second section of the drive ring is a key which completes the drive ring.

16. A fan assembly fastenable about a pole, the fan assembly comprising:

a collar clampable about the pole and including a drive ring support disposed above a motor housing support;

a motor housing clampable about the collar supported by the motor housing support, the motor housing including a drive gear;

a drive ring in two sections disposed about the collar and rotatably supported on the drive ring support of the collar, the drive ring including a driven mechanism driven by the drive mechanism of the motor housing, the drive ring including a plate extending outward from the collar and a lower driven gear closely spaced to the collar driven by the drive gear of the motor housing; and a plurality of fan blades coupled to the drive ring.

17. The fan assembly of claim 16 further including a coupling clampable about the pole beneath the collar to support the collar on the pole.

18. The fan assembly of claim 16 wherein a first section of the drive ring circumferentially surrounds the majority of the collar and the second section of the drive ring is a key which completes the drive ring.

19. A fan assembly comprising:

a collar in two halves clampable about a pole and including:

a drive ring support;

a motor housing support disposed below the drive ring support, and a clamp for slidably securing the two halves of the collar about the pole;

a coupling in two halves clampable about the pole below the collar for supporting the collar on the pole, the coupling including a clamp for securing the two halves about the pole, threaded fingers, and a hinged nut threadable onto the fingers to releasably secure the coupling with respect to the pole;

a motor housing in two halves hinged together and supported on the motor housing support of the collar, the motor housing including:

a battery compartment, a drive gear driven by a motor, and at least one mechanism for securing the two halves together about the collar;

a drive ring in two sections disposed about the collar and including:

a plate portion, a driven gear portion extending downward from the plate portion rotatably supported on the drive ring support of the collar and driven by the drive gear of the motor housing, a first section of the drive ring circumferentially surrounding a majority of the collar, a second section of the drive ring formed as a key which completes the drive ring, and at least one mechanism for securing the key to the first section of the drive ring; and fan blade retaining mechanisms on the plate portion of the drive ring, and a plurality of fan blades releasably coupled to the retaining mechanisms.

* * * * *